United States Patent [19]

Rieger

[11] Patent Number: 4,838,241

[45] Date of Patent: Jun. 13, 1989

[54] FIREPLACE NATURAL GAS AND PROPANE BURNER ASSEMBLY

[76] Inventor: Heinz H. Rieger, 17 Martin Road, Toronto, Ontario, Canada, M4S 2V1

[21] Appl. No.: 228,474

[22] Filed: Aug. 5, 1988

[51] Int. Cl.[4] ..... F24C 3/02

[52] U.S. Cl. ..... 126/92 R; 126/92 AC; 126/512; 431/328; 431/326

[58] Field of Search ..... 431/326, 328, 125, 350; 126/127, 92 R, 512, 86, 93, 92 AC; 44/535

[56] References Cited

U.S. PATENT DOCUMENTS

| | | | |
|---|---|---|---|
| 3,251,396 | 5/1966 | Nitsche | 431/328 |
| 3,556,707 | 1/1971 | Hine, Jr. | 431/328 |
| 3,947,229 | 3/1976 | Richter | 126/92 R |
| 4,189,297 | 2/1980 | Bratko et al. | 431/328 |
| 4,662,349 | 5/1987 | McKenzie | 431/328 |

FOREIGN PATENT DOCUMENTS

| | | | |
|---|---|---|---|
| 2160642 | 12/1985 | United Kingdom | 126/92 R |
| 2179438 | 3/1987 | United Kingdom | 126/92 R |
| 2185100 | 7/1987 | United Kingdom | 126/92 AC |

*Primary Examiner*—James C. Yeung
*Attorney, Agent, or Firm*—David W. Wong

[57] ABSTRACT

A burner assembly suitable for use in the fireplace is shown. The burner is operative with either natural gas or propane gas to produce a flame pattern closely resembles to that of a natural wood log fire yet there is virtually no formation of carbon monoxide gas in the exhaust.

8 Claims, 2 Drawing Sheets

FIREPLACE NATURAL GAS AND PROPANE BURNER ASSEMBLY

BACKGROUND OF THE INVENTION

This invention relates to gas burners and particularly relates to a fireplace gas burner suitable for use with natural gas and as well as with propane gas.

Gas fireplaces are becoming increasingly more popular because they are easier and cleaner to use than wood burning fireplaces, in that they are convenient to light and there is no messy ash to clean up after use. Furthermore, gas fireplaces do not require a complex flue system or chimney for venting the exhaust gas or smoke. However, a common drawback of gas fireplaces is the lack of likeness of the flaming pattern to that of a natural wood log fire. An important and most desirable pattern of the natural wood log fire is the appearance of yellow flames flickering among the logs. Heretofore, assemblies of gas burner were unable to produce such desirable flickering yellow flames without the inherent formation of unacceptable level of carbon monoxide gas. In U.S. patent application Ser. No. 169,234 by the Applicant of the present application it is shown several embodiments of gas burners that are operative to overcome the above drawbacks of common gas burners for fireplaces.

The present invention shows a gas burner operative with either natural gas or propane gas and the like in a gas fireplace to achieve the above stated desirable results.

SUMMARY OF THE INVENTION

It is the primary object of the present invention to provide a gas burner operative with either natural gas or propane gas and the like. This and other objects of the invention will become clear from an inspection of the detailed description of the invention and from the appended claims.

DETAILED DESCRIPTION OF THE PREFERRED EMBODIMENTS

Figures 1, 2, 4, 5, 6:
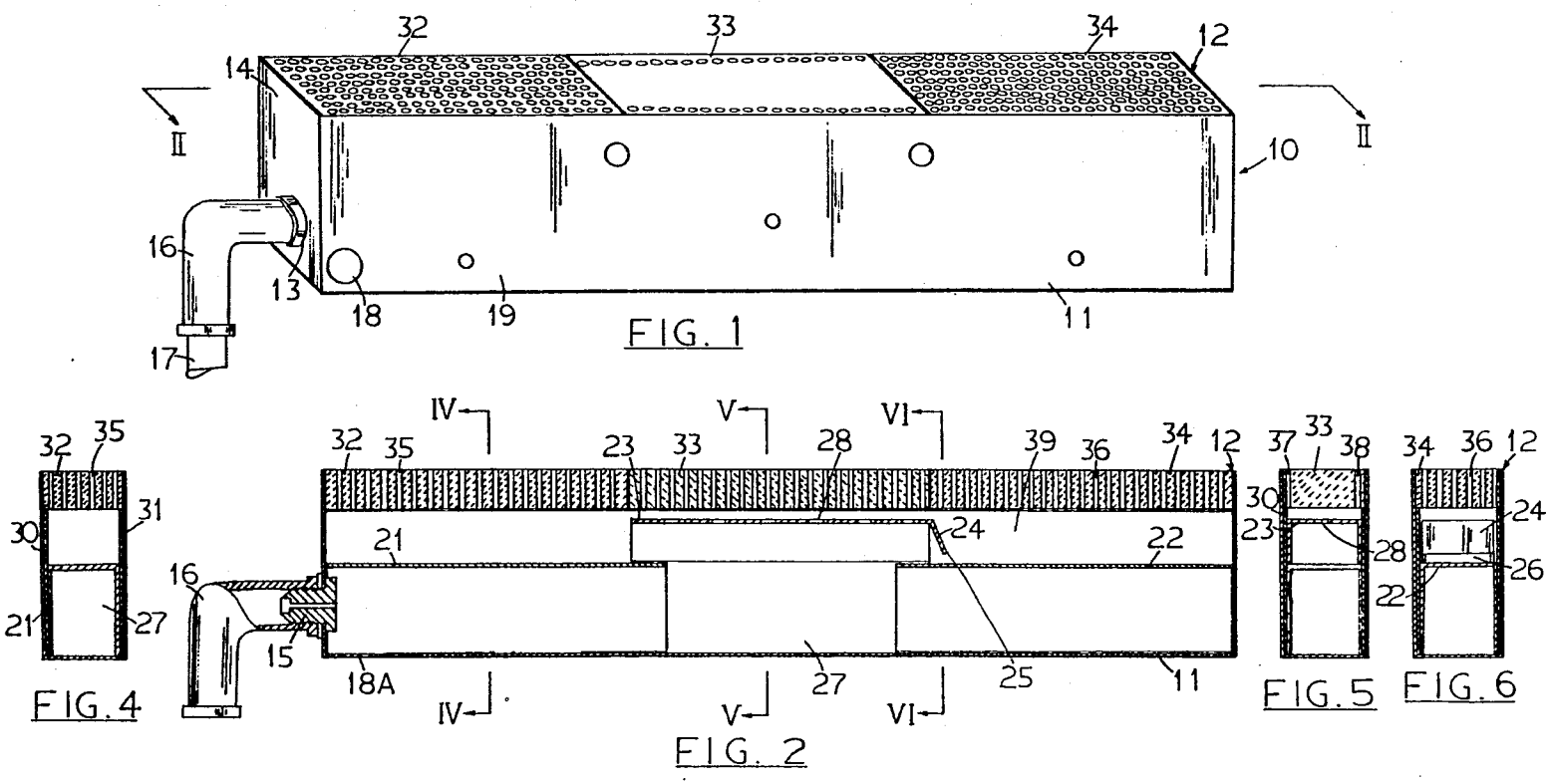
FIG. 1 is a perspective front elevation view of the gas burner according to the present invention.
FIG. 2 is a front partial sectional view thereof along section line II—II of FIG. 1.
FIG. 4 is a cross section view thereof along section line IV—IV of FIG. 2.
FIG. 5 is a cross section view thereof along section line V—V of FIG. 2.
FIG. 6 is a partial cross sectional view thereof along section line VI—VI of FIG. 2.
Figure 7:
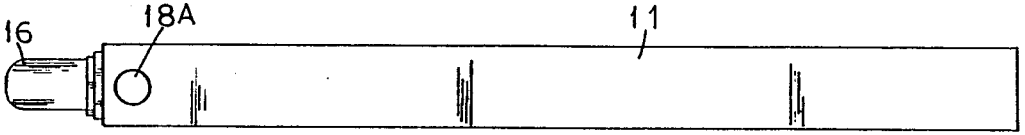
FIG. 7 is a bottom elevation view of the gas burner.

With reference to the drawings wherein like reference numerals designate corresponding parts in the several view, an exemplary gas burner assembly according to the present invention is shown generally by reference numeral 10. The assembly 10 has a rectangular casing 11 having an opened top 12 and a circular opening 13 formed on one end panel 14 for mounting the orifice 15. The gas supply is connected to the orifice 15 through an elbow coupler 16 and a feed pipe 17. Fresh air ports 18 are formed at the bottom corner of the front or back panels 19 or in both panels immediately adjacent to the orifice 15 and extension slots or openings may be formed around the orifice opening 13 to provide the primary fresh air supply to the burner and an additional fresh air port 18A may also be formed at the bottom panel 20 as shown in FIGS. 2 and 7 particularly for the burner primarily intended for use with propane gas.

Figure 3:
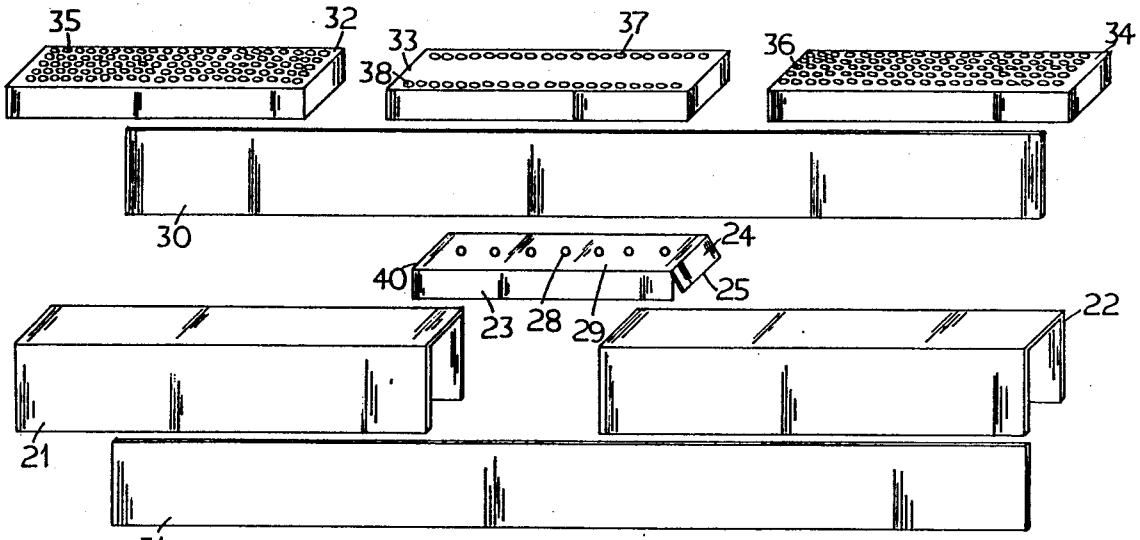
FIG. 3 is an exploded perspective view of the component parts of the gas burner.

A first channel member 21 having an inverted U-shaped cross section is located at the bottom portion in the casing 11 and located adjacent to the orifice 15. A second channel member 22 similar in structure to the first channel member 21 is located at the right bottom portion in the casing 11 distal from the orifice 15. A transfer cap member 23 having also an inverted U-shaped cross section is located over the first and second channel members 21 and 22 and bridging over the opposing end portions of these channel members as best shown in FIG. 2 and 3. The transfer cap member 23 has an opened end facing the end panel 14 of the casing 11 to which the orifice 15 is mounted. The other end of the transfer cap member 23 has an overhanging baffle panel 24 located at an angle to the vertical plane and having a lower edge 25 located slightly above the top surface of the second channel member 22 to form a narrow gap therebetween. The first and second channel members 21 and 22, the transfer cap member 23 in combination with the bottom and side panels of the casing 11 form a mixing chamber 27 in the casing 11 in direct communication with the orifice 15. A plurality of gas transfer openings 28 are formed on the top panel 29 of the transfer cap member 23. The first and second channel members 21 and 22, and the transfer cap member 23 are tightly retained in place in the casing 11 by two elongated rectangular spacer plates 30 and 31 fitted between the side panels 19 of the casing 11 and the first and second channel members 21 and 22 as well as the transfer cap member 23. Three distribution tiles 32, 33, and 34 are located at the top of the casing 11. The distribution tiles 32, 33, and 34 are made of a refractory material such as ceramic; and a plurality of vertical through openings 35 and 36 are formed in a honeycomb pattern therein. At least one row of vertical through openings 37 are formed along the rear lateral edge portion of three middle distribution tile 33 located directly above the transfer cap member 23. Alternatively as shown in FIG. 3 two rows of vertical through openings 37 and 38 may be formed along the front and rear lateral edge portions respectively of the middle distribution tile 33. It can be appreciated that all three distribution tiles may have the same honeycomb vertical through openings pattern formed therein except that some of the openings in the middle tile may be blocked by refractory cement such that only the selected single row or two rows of through openings are remaining to provide the same construction as stated above. Also, alternatively, a single elongated distribution tile may be provided instead of three distribution tile sections. A distribution chamber 39 is thus formed between the transfer cap member 23, the first and section channel member 21 and 22 and the distribution tiles 32, 33 and 34.

When the gas enters the burner assembly 10 through the orifice 15, it mixes with a predetermined amount of fresh air which is being drawn into the casing 11 by the venturi effect through the fresh air ports 18 and 18A into the casing 11. The gas and air mix within the mixing chamber 27, and the mixture is subsequently transferred to the distribution chamber 39 through the gas transfer openings 28 as well as through the narrow gap 26 and the opened end 40 of the transfer cap member 23. Due to the momentum of the in rushing gas, the gas and air mixture tend to rush out of the baffled end of the transfer cap member 23; however, the momentum of the mixture is reduced by the baffled panel 24 and thus eventually is forced to exit through the narrow gap 26 into the distribution chamber 39 and is subsequently released through the vertical through openings 36 of the distribution tiles 34 to the top of the burner to be ignited by the pilot light. The gas and air mixture passing through the transfer openings 28 of the transfer cap member 23 is forced to travel sideways before it is released through the two rows of vertical through openings 37 and 38 formed in the lateral portion of the middle distribution tile 33. The gas and air mixture exitting through the opened end 40 of the transfer cap member 23 has to travel through the zigzag path formed between the first channel member 21 and the transfer cap member 23 and furthermore it is in the reverse direction of the incoming gas. Thus, the speed of the gas and air mixture exitting through the opened end 40 of the transfer cap member 23 is also considerably reduced and is subsequently released through the through openings 35 of the distribution tile 32 to be lighted.

Obviously, numerous modifications and variations of the present invention are possible in light of the above teachings. It is therefore to be understood that within the scope of the appended claims, the invention may be practiced otherwise than as specifically described herein.

What is claimed is:

1. A natural gas and propane burner assembly comprising an elongated rectangular casing having an opened top, two side panels, two end panels and a bottom panel, an orifice means mounted to one end panel of said casing, extension openings formed on said one end panel and location adjacent to said orifice means, fresh air port means formed on a bottom corner of a first side panel of said casing and located immediately adjacent to said orifice means, a first channel member having an inverted U-shaped cross section and located in said casing and disposed adjacent to said orifice means, a second channel member having an inverted U-shaped cross section and located in said casing and disposed distal from said orifice means, a transfer cap member having an inverted U-shaped cross section and located in said casing and positioned in a bridging manner over two opposing end portions of said first channel member and second channel member, said transfer cap member having an over-hanging baffle end panel means located at one end therein distal from said orifice means, and said baffle end panel having a lower edge spaced from a top panel of said second channel means and forming a predetermined slot opening therewith, said transfer cap member having a plurality of transfer openings formed on a top panel therein, a distribution tile means located at said opened top of said casing, said distribution tile means having a plurality of vertical through openings formed therein in a honeycomb pattern in areas located above said first channel member and said second channel member, and at least one rew of vertical through openings being formed along a selected longitudinal edge portions therein located above said transfer cap member.

2. A natural gas and propane burner assembly according to claim 1 wherein said baffle end panel of said transfer cap member is positioned at an angle to the vertical plane.

3. A natural gas and propane burner assembly according to claim 2 including a second fresh air port means formed on a bottom corner of a second side panel of said casing and located immediately adjacent to said orifice means.

4. A natural gas and propane burner assembly according to claim 3 including an additional fresh air port measn formed in a bottom panel of said casing and located immediately adjacent to said orifice means.

5. A natural gas and propane burner assembly according to claim 4 including an elongated spacer plate means located between said first side panel of said casing and said first channel member, said second channel member and said transfer cap member.

6. A natural gas and propane burner assembly according to claim 5 including a second elongated spacer plate means located between said second side panel of said casing and said first channel member, said second channel member and said transfer cap member.

7. A natural gas and propane burner assembly according to claim 6 wherein said distribution tile means is made of a refractory material and comprising at least of three sections, one section being located above said first channel member, a second section being located above said second channel member, and a middle section being located above said transfer cap member, said plurality of vertical through openings in a honeycomb pattern being formed in said first section and said second section, and said at least one row of vertical through openings being formed in a rear lateral edge portion of said middle section.

8. A natural gas and propane burner assembly according to claim 7 wherein said middle section includes a second row of through openings formed along a longitudinal front edge portion of said middle section.

* * * * *